US005172129A

United States Patent [19]

Bouko et al.

[11] Patent Number: 5,172,129

[45] Date of Patent: Dec. 15, 1992

[54] ANTENNA WITH CIRCULAR POLARIZATION FOR ANTENNA ARRAY

[75] Inventors: Jean Bouko, Villemoisson s/Orge; Marcel Grosbois, L'Hay les Roses, both of France

[73] Assignee: Thomson-CSF, Puteaux, France

[21] Appl. No.: 606,174

[22] Filed: Oct. 31, 1990

[30] Foreign Application Priority Data

Nov. 24, 1989 [FR] France ..... 89 15473

[51] Int. Cl.[5] ..... H01Q 21/240

[52] U.S. Cl. ..... 343/797; 343/756; 343/795

[58] Field of Search ..... 343/795, 797, 756

[56] References Cited

U.S. PATENT DOCUMENTS 4,772,890 9/1988 Bowen et al. ..... 343/700 MS
4,774,520 9/1988 Bouko et al. ..... 343/783

FOREIGN PATENT DOCUMENTS 1416343 12/1975 United Kingdom .
2048571 12/1980 United Kingdom ..... 343/797
2191044 12/1987 United Kingdom .
2207005 1/1989 United Kingdom .
2211024 6/1989 United Kingdom .

*Primary Examiner*—Michael C. Wimer
*Attorney, Agent, or Firm*—Pollock, VandeSande & Priddy

[57] ABSTRACT

An antenna excited by a symmetrical strip line (1) including two peripheral conductors (3, 3') positioned respectively above and below a central conductor (2). It comprises, at the end of the symetrical strip line, a first dipolar radiating element (10), including two quarter wave branches (11, 11') formed by extending each of the peripheral conductors (3, 3') in their plane and a quarter wave branch (12) formed by extending the central conductor (2) in its plane, in an opposite direction; a second dipolar radiating element (20), orthogonal to the first one, including two quarter wave branches (21, 22) formed by the folding of the cental conductor (2) and of one (3) of the peripheral conductors; and distributor and phase-shifter means (30) to excite the dipolar radiating elements (10, 20) by similar respective signals, having the same amplitude but being phase-shifted by 90°. These distributor and phase-shifter means (30) are formed by an axial quarter wave segment of a symmetrical strip line (31, 32, 32'), said symmetrical strip line segment extending the symmetrical strip supply line beyond the first dipolar radiating element, the branches of the second dipolar radiating element being formed at the end of this symmetrical strip line segment, and the dimensions of this symmetrical strip line segment and the inherent characteristics of its dielectric (33, 33') being chosen so as to excite the dipolar radiating elements by similar respective signals, having the same amplitude but being phase-shifted by 90°.

5 Claims, 1 Drawing Sheet

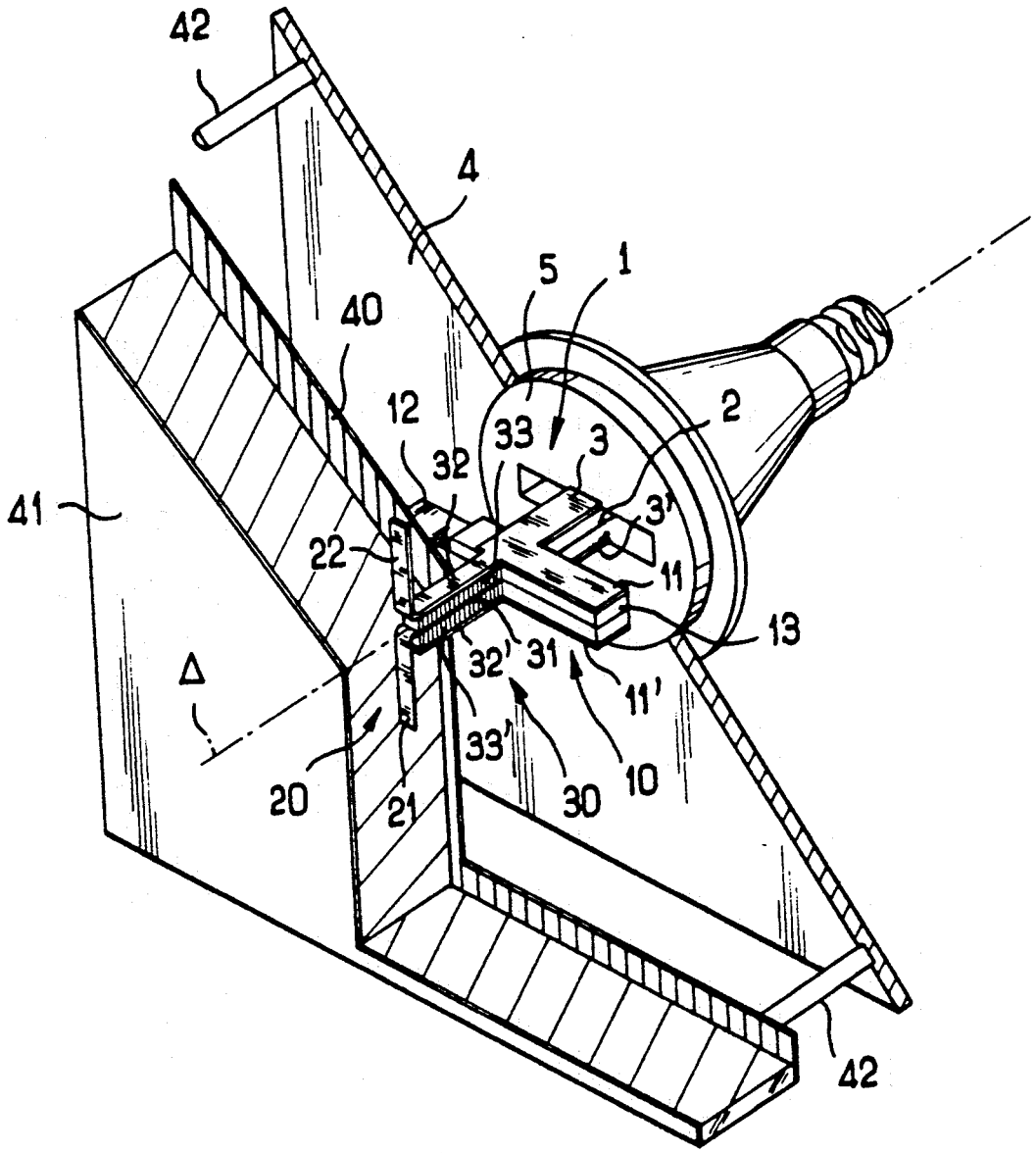
42
4
5
1
40
12
33
3
2
32
3'
41
22
11
13
32'
31
11'
Δ
33'
10
20
21
30
42

ANTENNA WITH CIRCULAR POLARIZATION FOR ANTENNA ARRAY

BACKGROUND OF THE INVENTION

1. Field of the Invention

The present invention concerns an antenna with circular polarization, notably an elementary antenna for antenna arrays.

2. Description of the Prior Art

There are many circumstances in which it is desirable to have a circular polarization, notably in radar applications where it is known that circular polarization enables the elimination of the echos produced by obstacles with isotropic reflection, especially rain echos (caused by droplets of water that are in suspension in the clouds).

Indeed, the wave emitted in a given circular polarization, for example a right-hand circular polarization, will be phase-shifted by 180° by reflection on the obstacle and will therefore be sent back with a reverse polarization, a left-hand circular polarization in this example. It will then be easy, at the receiver, to get rid of this reflection by means of a crossed polarization suppressor.

One of the aims of the invention is to propose an antenna with circular polarization such as this, notably to serve as a primary source (elementary antenna) in an array antenna, and capable of being supplied directly by a so-called symmetrical strip line.

A symmetrical strip line is constituted by a flat central conductor forming a coaxial cable core, sandwiched between two dielectric thicknesses (possibly air) that are themselves covered on their external surfaces by conductors located in front of the central conductor and supplied in parallel, hence conductors that are equipotential, forming peripheral ground conductors.

This symmetrical strip line technology is very common, especially in the array antennas, for it makes it easy to set up the complex distributors needed for the supply of the different primary sources of the array.

By contrast, one of the drawbacks of the symmetrical strip line technology lies in the fact that, until now, there has been no primary source with circular polarization directly extending from the symmetrical strip supply line.

Indeed, the known primary sources with circular polarization (helical antennas, "candle" type antennas etc.) do not work in the same mode as the symmetrical strip line and, therefore, in addition to the mechanical and electrical interfacing of the source with the symmetrical strip line, they necessitate a change in excitation mode that is detrimental to optimal functioning of the source.

Besides, the radiating elements made up till now in symmetrical strip line technology do not provide any circular polarization and, therefore, in order to obtain a polarization mode such as this, it is necessary to add polarizers to them, such as polarizers with dielectric strips, screws, wires, etc. with all the correlative matching losses and manufacturing difficulties.

SUMMARY OF THE INVENTION

An object of the invention is to propose a new form of primary source with circular polarization which can directly extend the symmetrical strip supply line, generally formed by one of the branches of an antenna array distributor.

With a source such as this, in order to produce the radiation, it is possible to use the TM or quasi-TM mode, characteristic of the symmetrical strip lines, which gives an excellent bandwidth.

It will be seen, furthermore, that the very simple structure of the source according to the invention leads to low-cost factory production which is especially advantageous for making arrays that include a large number of primary sources.

Essentially, the invention provides for extending the supply line by two orthogonal symmetrical strip line dipoles and a phase-shifter inserted between the two dipoles, so as to create a single-block primary source radiating a circularly-polarized wave (it is known, indeed, that to produce a circularly-polarized wave, two neighboring orthogonal dipoles must be excited by signals that have the same amplitude but are in quadrature).

More precisely, the antenna of the invention, which is excited by a symmetrical strip supply line, including two peripheral conductors positioned respectively above and below a central conductor comprises, at the end of this symmetrical strip supply line:

a first dipolar radiating element, including two quarter wave branches formed by extending each of the peripheral conductors in their plane, transversally and in a same direction, and one quarter wave branch formed by extending the central conductor in its plane, parallel to the above-mentioned two branches but in an opposite direction;

a second dipolar radiating element, orthogonal to the first one, including two quarter wave branches formed by the folding, in opposite directions, of the central conductor and of one of the peripheral conductors, these two branches being coplanar and coaxial and extending perpendicularly to the planes of the conductors, and distributor and phase-shifter means to excite the dipolar radiating elements by similar respective signals, having the same amplitude but being phase-shifted by 90°.

Very advantageously, the distributor and phase-shifter means are formed by an axial quarter wave segment of a symmetrical strip line, said symmetrical strip line segment extending the symmetrical strip supply line beyond the first dipolar radiating element, the branches of the second dipolar radiating element being formed at the end of this symmetrical strip line segment, and the dimensions of this symmetrical strip line segment and the inherent characteristics of its dielectric being chosen so as to excite the dipolar radiating elements by similar respective signals, having the same amplitude but being phase-shifted by 90°.

Preferably, the antenna further includes a plane polarization filter, for example a network of wires, interposed between the dipolar radiating elements and extending in parallel to these elements. The network of wires may notably be positioned against the internal face of a radome, the parts of the antenna located in front of this network of wires being embedded in the wall of this radome.

BRIEF DESCRIPTION OF THE DRAWING

We shall now describe an exemplary embodiment of the invention, with reference to the single appended figure which represents a view in perspective of the antenna according to the invention, positioned in a radome shown in a partially cut-away view.

DESCRIPTION OF THE PREFERRED EMBODIMENT

In the drawing figure, the reference 1 designates the symmetrical strip supply line, formed by a central conductor 2 sandwiched between two peripheral conductors 3, 3' forming ground half-planes. These three conductors are made in the form of plates or rigid strips positioned in parallel to one another and separated by an appropriate dielectric (which may be air and, in this case, spacers are simply provided to hold the different elements of the line precisely in their place).

The symmetrical strip line may notably form the end of one of the branches of an array antenna distributor (not shown), this end going through a ground plane 4 with the interposition of an insulator 5 further providing for the mechanical holding and positioning of the supply line.

This supply line excites, first of all, a first horizontal dipole 10 designed to produce the horizontal component of the circular polarization of the wave.

It will be noted incidentally that the terms such as "horizontal" or "vertical" are clearly not restrictive and refer solely to the illustrated embodiment which corresponds to the most common configuration in array antennas, where the symmetrical strip line distributors are generally horizontal. However, this orientation is in no way restrictive and any other absolute orientation in space could be chosen provided that the condition, cited further below, of orthogonality between the two dipoles is met.

Following the same line of thought, although the invention has been described herein essentially in the form of a source emitting a circularly-polarized wave, this very same antenna can also be used, by virtue of the principle of reciprocity, as a reception antenna, without any modification.

The horizontal dipole 10 is made by the transversal extension (i.e. the extension perpendicular to the general direction, represented by the axis Δ, of the symmetrical strip line), of the peripheral conductors 3, 3' of the supply line by respective branches 11, 11', on a first side (the same for both branches 11 and 11') of the axis Δ. The side of the dipole is formed by a branch 12 formed by the extension, transversally but on the other side of the axis Δ, of the central conductor of the supply line. It is possible to make provision, between the branches 11 and 11', for a low loss dielectric 13 providing, notably, for the mechanical rigidity of the assembly.

The branches 11, 11' and 12 have the same length, equal to about a quarter wave (the wavelength being, of course, considered in the dielectric).

It will be noted that the metal ground plane 4 plays the role of a short-circuit plane for the horizontal dipole 10.

The symmetrical strip line is then extended axially on a length of about one quarter wave (the role played by this section will be explained further below) then, at the end of this extended line, a second, vertical dipole 20 is formed, designed to produce the vertical component of the circularly-polarized wave.

This dipole 20 is formed by a downward folding of the central conductor 2 from its plane which provides the branch 21 perpendicular to 2 an upward folding of one of the peripheral conductors (herein, the upper conductor 3), which provides the second branch 22 of the dipole 20 perpendicular to the upper conductor 3. These two branches 21 and 22 also have a length of about one quarter wave.

The part of a line between the two dipoles, referenced 30, will serve as a phase-shifter enabling the supply of the two respective dipoles in quadrature.

To this effect, between the central conducting part 31 and the peripheral conducting parts 32, 32' of this symmetrical strip line section, respectively at 33, 33', a dielectric is positioned. The characteristics of this dielectric are such that the desired phase shift of 90° is obtained (taking account also of the length of the section 30).

Preferably, a low loss material will be chosen for this dielectric 33, 33' so as to have the best behavior under power for the source thus formed.

Indeed, the power-handling capacity of this source is essentially limited only by losses, if any, in the dielectric since, by construction, virtually all the matching losses are eliminated, the entire element being made exclusively by means of a symmetrical strip line technology.

Besides, the relative dimensions of the different parts of the line are chosen so that, in a manner known per se, there is obtained a division by two of the radio-electrical energy at the point of excitation of the horizontal dipole. Thus, there will be two orthogonal components of the same amplitude available, enabling the desired circular polarization to be achieved.

Finally, at one quarter wave behind the vertical dipole 20, the antenna has a network of wires 40 which fulfills two essential functions:

first of all, it forms the short-circuit plane of the vertical dipole 20, since the wires of the network 40 are parallel to the orientation of this dipole, and it acts as a crossed polarization filter (notably in reception) for the horizontal dipole 10, so that the wave emitted or received by this dipole 10 is as linearly polarized as possible in the horizontal direction.

Advantageously, the network of wires 40 may be mounted on the rear face of a radome 41, formed by a light foam in which the vertical dipoles 20 of the antenna array will be embedded. The radome and the network are held at a precise distance from the ground plane 4 by means of spacers 42.

What is claimed is:

1. An antenna with circular polarization for an antenna array, said antenna being excited by a symmetrical strip signal supply line including two parallel peripheral conductors positioned respectively above and below a central conductor, comprising:

a first dipole radiating element, including two quarter wave branches comprising each of the peripheral conductors extended transversely to said symmetrical strip supply line, and in the same direction, and further comprising a quarter wave branch formed by extending the central conductor parallel to the two branches but in an opposite direction;

a second dipole radiating element, orthogonal to the first dipole radiating element, including two additional quarter wave branches comprising:

the central conductor and one of the peripheral conductors, respectively extending in opposite directions in the same plane perpendicular to the planes of the peripheral conductors; and means connecting said dipole radiating elements to excite the dipole radiating elements by signals having the same amplitude but being phase-shifted by 90°.

2. The antenna of claim 1, wherein said means to excite are formed by an axial quarter wave segment of a symmetrical strip line, said symmetrical strip line segment extending the symmetrical strip supply line beyond the first dipole radiating element, the second dipole radiating element being formed at the end of the symmetrical strip line segment, the dimensions of the symmetrical strip line segment and a related dielectric being chosen to excite the dipole radiating elements by similar respective signals, having the same amplitude but phase-shifted by 90°.

3. The antenna of claim 1, further including a plane polarization filter interposed between the dipole radiating elements and extending in parallel to said second dipole radiating element.

4. The antenna of claim 3, wherein the plane polarization filter is formed by a network of wires.

5. The antenna of claim 4, wherein the network of wires is positioned against the internal face of a radome, the second dipole radiating element located in front of said network of wires and being embedded in the wall of said radome.

* * * * *